US006135078A

United States Patent [19]

Doi et al.

[11] Patent Number: 6,135,078

[45] Date of Patent: Oct. 24, 2000

[54] VARIABLE VALVE TIMING CONTROL APPARATUS FOR AN INTERNAL COMBUSTION ENGINE

[75] Inventors: Toshinori Doi, Kariya; Osamu Sato, Takahama; Jouji Yamaguchi, Kariya; Akira Hori, Handa, all of Japan

[73] Assignee: Denso Corporation, Japan

[21] Appl. No.: 09/190,221

[22] Filed: Nov. 13, 1998

[30] Foreign Application Priority Data

Nov. 18, 1997 [JP] Japan ..... 9-317190

[51] Int. Cl.[7] ..... F01L 1/34; F01L 13/00

[52] U.S. Cl. ..... 123/90.18; 123/90.17; 73/116; 73/117.3

[58] Field of Search ..... 123/90.15, 90.17, 123/90.18, 90.31; 73/116, 117.2, 117.3, 118.1

[56] References Cited

U.S. PATENT DOCUMENTS

| | | | |
|---|---|---|---|
| 5,080,055 | 1/1992 | Komatsu et al. | 123/90.17 |
| 5,715,780 | 2/1998 | Haller | 123/90.17 |
| 5,769,044 | 6/1998 | Moriya | 123/90.17 |
| 5,881,690 | 3/1999 | Park | 123/90.18 |
| 5,924,397 | 7/1999 | Moriya et al. | 123/90.18 |

FOREIGN PATENT DOCUMENTS

| | | |
|---|---|---|
| 443514 | 8/1991 | European Pat. Off. . |
| 9-32519 | 2/1997 | Japan . |
| 10-30413 | 2/1998 | Japan . |
| 2221306 | 1/1990 | United Kingdom . |

OTHER PUBLICATIONS

Pub. #910009—"The Variable Valve Timing System—Application on a V8 Engine" A. Titolo, Fiat Auto, 1991 Winner of the Charles Deutsch Prize. pp. 8–15.

*Primary Examiner*—Weilun Lo
*Attorney, Agent, or Firm*—Nixon & Vanderhye PC

[57] ABSTRACT

A cam has a profile variable from a high lift curve to a low lift curve in an axial direction. A driving mechanism shifts a cam shaft in the axial direction. A phase adjusting mechanism adjusts the rotational phase of the cam shaft relative to a driving shaft of the internal combustion engine. Angle detecting teeth are shift detecting teeth are alternately arranged on a same cylindrical surface of the cam shaft. Each shift detecting tooth incline at a predetermined angle with respect to an axis of the cam shaft so as to provide angularly advanced and retarded portions in a rotational direction of the cam shaft. A pickup generates sensing signals responsive to the angle detecting teeth and the shift detecting teeth. The sensor faces the angularly advanced portion of the shift detecting tooth when the low lift curve of the cam is selected and faces the angularly retarded portion of the shift detecting tooth when the high lift curve of the cam is selected.

5 Claims, 3 Drawing Sheets

VARIABLE VALVE TIMING CONTROL APPARATUS FOR AN INTERNAL COMBUSTION ENGINE

BACKGROUND OF THE INVENTION

The present invention relates to a valve timing control apparatus preferably used for optimizing an open or close timing of at least one of an intake or exhaust valve of an internal combustion engine in accordance with engine operating conditions.

Various valve timing control apparatuses are conventionally used in internal combustion engines for adjusting the rotational phase difference between a crank shaft and a cam shaft. For example, Published Japanese Patent Application No. Kokai 9-32519 discloses one conventional variable valve timing control apparatus for varying a valve timing and/or a lift amount of at least one of intake and exhaust valves by shifting a cam shaft in an axial direction to select a preferable cam profile effective to the associated intake or exhaust valve.

SUMMARY OF THE INVENTION

An object of the present invention is to provide a variable valve timing control apparatus that is simple in construction and easy to install.

In order to accomplish this and other related objects, an aspect of the present invention provides a variable valve timing control apparatus for an internal combustion engine comprising a driven shaft driven by a driving force of the internal combustion engine, and a cam provided on the drive shaft. The cam has a profile for opening or closing an associated valve of the internal combustion engine. The profile is variable from a high lift curve to a low lift curve in accordance with a movement of an engaging point between the cam and the associated valve in an axial direction. A driving mechanism is provided for shifting the driven shaft in the axial direction. A phase adjusting mechanism is provided for adjusting the rotational phase of the driven shaft relative to a driving shaft of the internal combustion engine. At least one angle detecting tooth is provided on an cylindrical surface of the driven shaft for detecting a rotational angle of the driven shaft. At least one shift detecting tooth is provided on the cylindrical surface of the driven shaft for detecting a shift amount of the driven shaft in the axial direction. The shift detecting tooth is inclined at a predetermined angle with respect to an axis of the driven shaft so as to provide angularly advanced and retarded portions in a rotational direction of the driven shaft. A sensor is provided for generating sensing signals responsive to the angle detecting tooth and the shift detecting tooth. The sensor faces the angularly advanced portion of the shift detecting tooth when the low lift curve of the cam is selected and faces the angularly retarded portion of the shift detecting tooth when the high lift curve of the cam is selected.

Another aspect of the present invention provides a variable valve timing control apparatus for an internal combustion engine comprising a driven shaft driven by a driving force of the internal combustion engine, and a cam provided on the drive shaft. The cam has a profile for opening or closing an associated valve of the internal combustion engine. The profile is variable from a high lift curve to a low lift curve in accordance with a movement of an engaging point between the cam and the associated valve in an axial direction. A driving mechanism is provided for shifting the driven shaft in the axial direction. A phase adjusting mechanism is provided for adjusting the rotational phase of the driven shaft relative to a driving shaft of the internal combustion engine. A plurality of angle detecting teeth are provided on an cylindrical surface of the driven shaft for detecting a rotational angle of the driven shaft. A plurality of shift detecting teeth are provided on the cylindrical surface of the driven shaft for detecting a shift amount of the driven shaft in the axial direction. Each of the shift detecting teeth inclines at a predetermined angle with respect to an axis of the driven shaft so as to provide angularly advanced and retarded portions in a rotational-direction of the driven shaft. A sensor is provided for generating sensing signals responsive to the angle detecting teeth and the shift detecting teeth. The angle detecting teeth and the shift detecting teeth are alternately arranged.

BRIEF DESCRIPTION OF THE DRAWINGS

The above and other objects, features and advantages of the present invention will become more apparent from the following detailed description which is to be read in conjunction with the attached drawings, in which.

DESCRIPTION OF THE PREFERRED EMBODIMENT

A preferred embodiment of the present invention will be explained hereinafter with reference to the attached drawings.

Figure 1:
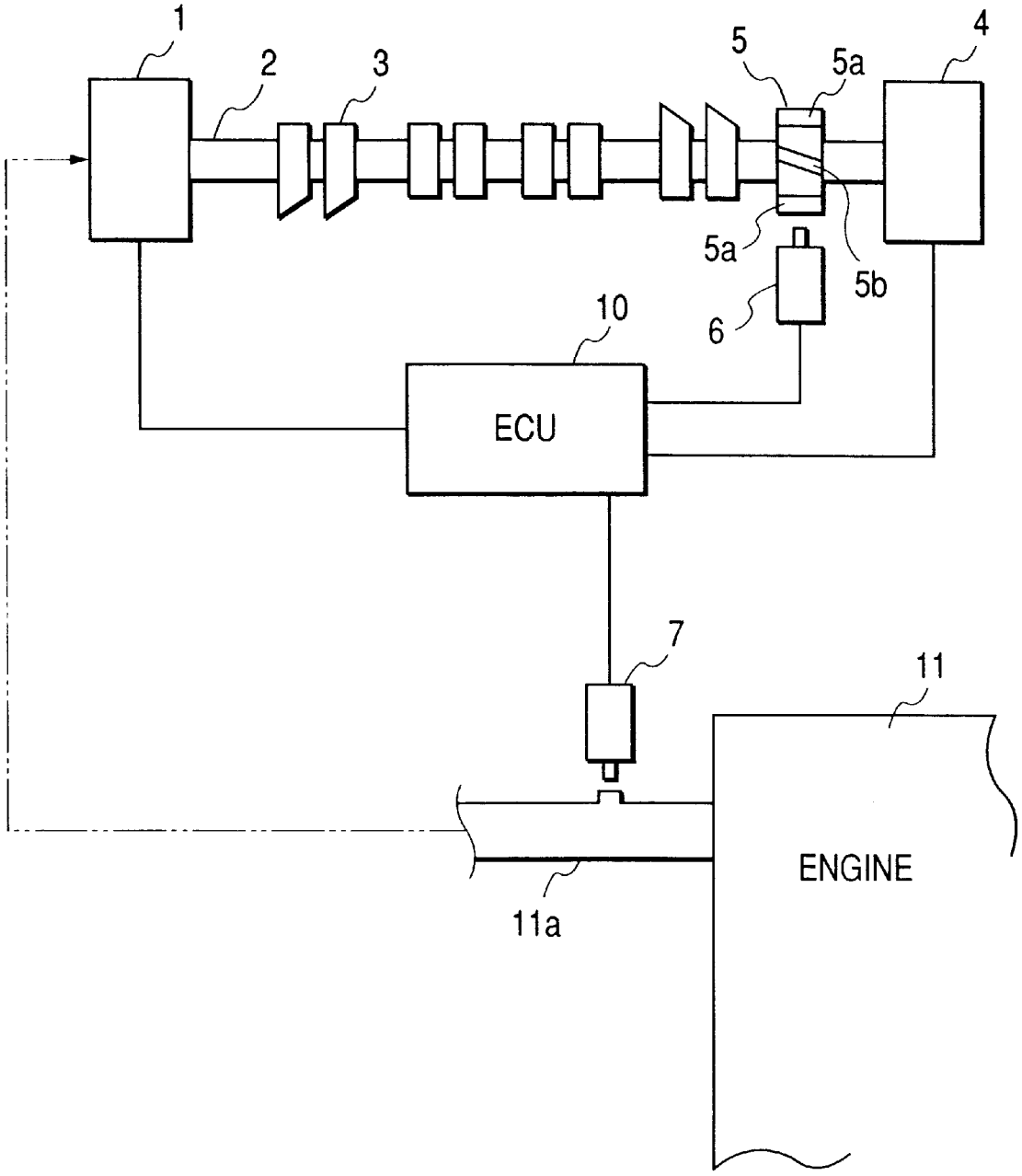
FIG. 1 is a schematic view showing a variable valve timing control apparatus in accordance with a preferred embodiment of the present invention.

FIG. 1 shows a variable valve timing control apparatus which is hydraulically operated to control the valve timing and/or lift amount of an intake (or exhaust) valve.

The variable valve timing control apparatus comprises a phase adjusting mechanism 1, a cam shaft 2, a cam 3, a drive mechanism 4, a pulser 5, and an electromagnetic pickup 6.

The phase adjusting mechanism 1 adjusts a rotational phase between the cam shaft 2 and a crank shaft 11*a* of an internal combustion engine 11. Various types of phase adjusting mechanisms are conventionally known. For example, the phase adjusting mechanism 1 may comprise a ring gear with a helical spline disposed between a crank shaft rotary member and a cam shaft rotary member, or may be a vane type phase adjusting mechanism. The valve timing of the intake (or exhaust) valve can be advanced or retarded by the phase adjusting mechanism 1.

The cam 3 has a cam profile continuously varying in the axial direction thereof, from a high lift curve for use at high engine speeds to a low lift curve for use at low engine speeds.

The drive mechanism 4, provided at an opposite end of the cam shaft 2, hydraulically shifts the cam shaft 2 in the axial direction. When the cam shaft 2 slides in the axial direction, the cam profile effective to the associated intake (or exhaust) valve varies in accordance with the shift position of the cam shaft 2.

Figure 3A:
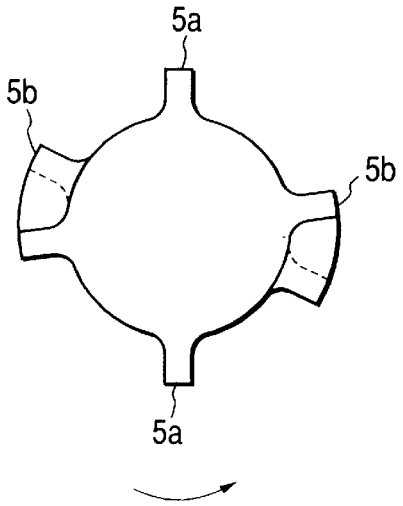
FIGS. 3A and 3B are views showing the pulser shown in FIG. 2.
Figure 3B:
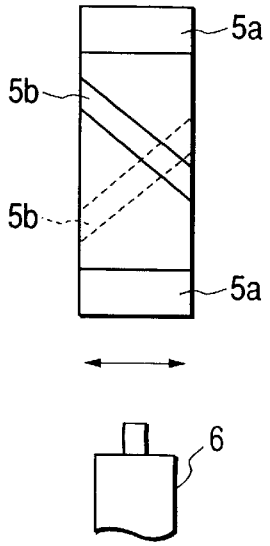

The pulser 5 rotates together with the cam shaft 2. As shown in FIGS. 3A and 3B, the pulser 5 has a pair of angle detecting teeth 5*a* and a pair of shift detecting teeth 5*b* radially projecting from the cylindrical surface thereof. The angle detecting teeth 5*a* are disposed at angular intervals of 180°. The shift detecting teeth 5*b* are disposed at angular intervals of 180° and offset from the angle detecting teeth 5*a*. The pulser 5 rotates in a direction of an arrow shown in FIG. 3A and shifts in a direction of an arrow shown in FIG. 3B.

The electromagnetic pickup 6, serving as a sensor, is disposed around the pulser 5 to generate a cam angle signal in response to each passage of the angle detecting teeth 5*a* and the shift detecting teeth 5*b* in accordance with the rotation of the cam shaft 2.

Each of the angle detecting teeth 5*a* is parallel to the axis of the cam shaft 2. Each of the shift detecting teeth 5*b* is inclined at a predetermined angle with respect to the axis of the cam shaft 2.

Figure 2:
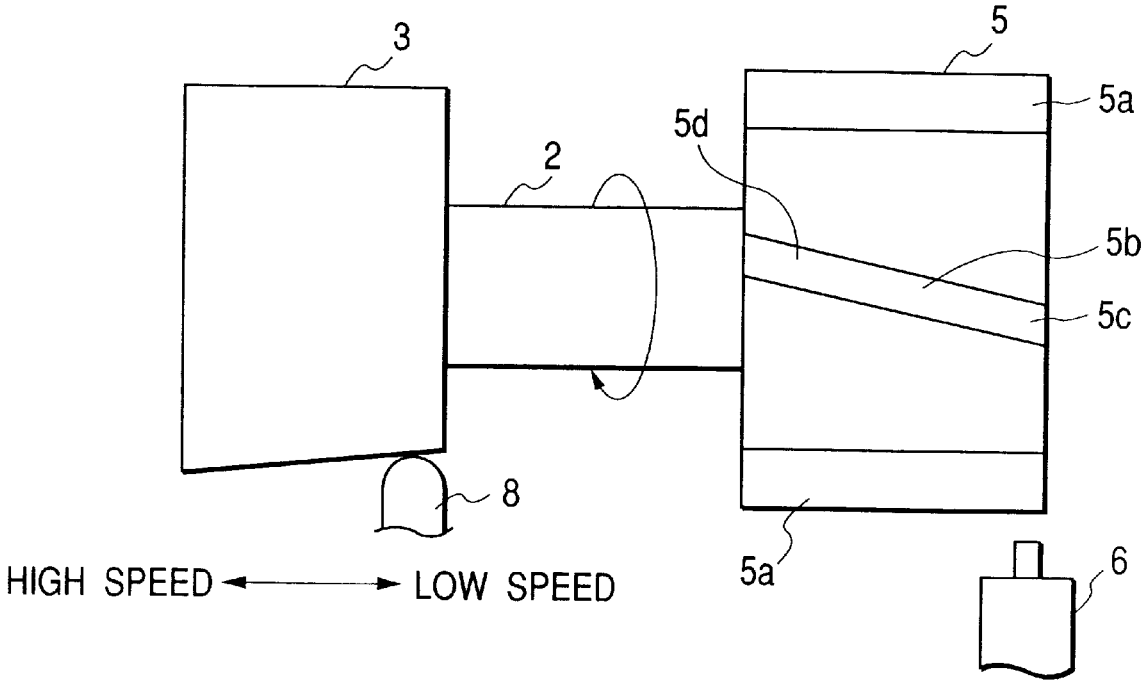
FIG. 2 is an enlarged view showing a cam and a pulsor used in the variable valve timing control apparatus in accordance with the preferred embodiment of the present invention.

FIG. 2 shows a condition where a stem 8 of the associated valve is engaged with the cam 3 along the low-speed cam profile. In this case, an angularly advanced portion 5*c* of the shift detecting tooth 5*b* faces the electromagnetic pickup 6. On the other hand, the high-speed cam profile is selected, an angularly retarded portion 5*d* of the shift detecting tooth 5*b* faces the electromagnetic pickup 6.

A crank angle sensor 7 is provided adjacent to a crank angle detecting tooth (not shown) attached on the crank shaft to produce a crank angle signal in response to each passage of the crank angle detecting tooth.

An engine control unit (ECU) 10 controls the phase adjusting mechanism 1 and the driving mechanism 4 in accordance with engine operating conditions known from sensor signals sent from the electromagnetic pickup 6, the crank angle sensor 7, and other sensors.

The above-described variable valve timing control apparatus operates in the following manner.

(1) Phase Detection

Figure 4:
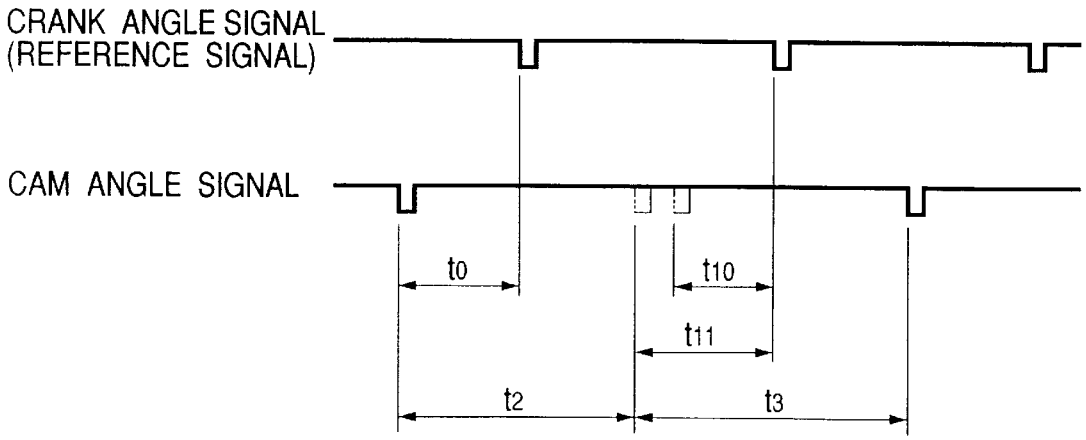
FIG. 4 is a time chart showing a relationship between a crank angle signal and a cam angle signal.

FIG. 4 shows the crank angle signal (i.e., reference signal) sent from the crank angle sensor 7 and the cam angle signal sent from the electromagnetic pickup 6. The ECU 10 compares a time difference $t_0$ representing a phase difference between the cam angle signal of the angle detecting tooth 5*a* and the crank angle signal (i.e., reference signal), thereby detecting the rotational phase of the cam shaft 2 (i.e., the phase of the valve timing) relative to the crank shaft.

(2) Shift Amount Detection

When the cam shaft 2 is shifted in the axial direction by the driving mechanism 4, the phase of the cam angle signal corresponding to the shift detecting tooth 5*b* relative to the crank angle signal (i.e., reference signal) varies in response to the shift movement of the cam shaft 2 as shown by $t_{10}$ and $t_{11}$ in FIG. 4.

When the rotational phase between the cam shaft 2 and the crank shaft is changed by the phase adjusting mechanism 1, the cam angle signals responsive to the angle detecting tooth 5*a* and the shift detecting tooth 5*b* are simultaneously shifted with respect to the crank angle signal (i.e., reference signal).

An accurate shift amount of the cam shaft 2 in the axial direction can be known by obtaining the difference between phases of respective cam angle signals responsive to neighboring teeth 5*a* and 5*b* with respect to the crank angle signal (i.e., reference signal). More specifically, the shift amount of the cam shaft 2 is represented by $(t_{10}-t_0)$ or $(t_{11}-t_0)$ in FIG. 4.

As the angle detecting teeth 5*a* and the shift detecting teeth 5*b* are alternately arranged, the phase differences are quickly detectable. Accordingly, the axial shift amount of the cam shaft 2 is quickly detectable.

Furthermore, providing the angle detecting teeth 5*a* and the shift detecting teeth 5*b* on the same cylindrical surface of the pulser 5 makes it possible to use a single electromagnetic pickup 6 to detect the relative phase and the shift amount of the cam shaft 2. Thus, the total part number is small, the assembling is simple, and the manufacturing cost is low.

Furthermore, when the low-speed cam profile is selected, the advanced side of the shift detecting tooth 5*b* approaches the pickup 6 earlier than other portions, producing a high-voltage detection signal. This arrangement makes it possible to accurately detect the shift amount of the cam shaft 2 even in engine startup and/or idling conditions where the engine speed is low. Thus, the engine can be accurately driven in such unstable conditions.

It is possible to provide a cylinder discriminating tooth on the pulser 5 and use a detection signal responsive to this cylinder discriminating tooth as a crank angle signal. Furthermore, it is possible to incline the cylinder discriminating tooth with respect to the axis of the cam shaft 2 to obtain the shift amount of the cam shaft 2 in addition to the crank angle signal.

According to the above-described embodiment, the axial shift amount of the cam shaft 2 is obtained based on the difference $(t_{10}-t_0)$ or $(t_{11}-t_0)$ in FIG. 4. However, the axial shift amount of the cam shaft 2 can be obtained by detecting a time $t_2$ or $t_3$ between two cam angle signals responsive to the neighboring teeth 5*a* and 5*b*.

According to the above-described embodiment, the phase adjusting mechanism 1 and the driving mechanism 4 are separately provided. However, it is possible to integrate the phase adjusting mechanism 1 and the driving mechanism 4.

As apparent from the foregoing description, the present invention provides a variable valve timing control apparatus for an internal combustion engine (11), comprising a driven shaft (2) driven by a driving force of the internal combustion engine, and a cam (3) provided on the drive shaft (2). The cam (3) has a profile for opening or closing an associated valve (8) of the internal combustion engine. The profile is variable from a high lift curve to a low lift curve in accordance with a movement of an engaging point between the cam (3) and the associated valve (8) in an axial direction. A driving mechanism (4) is provided for shifting the driven shaft (2) in the axial direction. A phase adjusting mechanism (1) is provided for adjusting the rotational phase of the driven shaft (2) relative to a driving shaft (11*a*) of the internal combustion engine. At least one angle detecting tooth (5*a*) is provided on an cylindrical surface of the driven shaft (2) for detecting a rotational angle of the driven shaft (2). At least one shift detecting tooth (5*b*) is provided on the cylindrical surface of the driven shaft (2) for detecting a shift amount of the driven shaft (2) in the axial direction. The shift detecting tooth (5*b*) inclines at a predetermined angle with respect to an axis of the driven shaft (2) so as to provide angularly advanced and retarded portions (5*c*, 5*d*) in a rotational direction of the driven shaft (2). A sensor (6) is provided for generating sensing signals responsive to the angle detecting tooth (5*a*) and the shift detecting tooth (5*b*).

It is preferable that the sensor (6) faces the angularly advanced portion (5*c*) of the shift detecting tooth (5*b*) when the low lift curve of the cam (3) is selected and faces the angularly retarded portion (5*d*) of the shift detecting tooth (5*b*) when the high lift curve of the cam (3) is selected.

This arrangement makes it possible to accurately detect the shift amount of the driven shaft (2) even in engine startup and/or idling conditions where the engine speed is low. Thus, the engine can be accurately driven in such unstable conditions.

It is also preferable that a plurality of angle detecting teeth (5*a*) and a plurality of shift detecting teeth (5*b*) are alternately arranged on a same cylindrical surface of the driven shaft (2).

According to this arrangement, the angle detecting teeth (5*a*) and the shift detecting teeth (5*b*) are collected on the same cylindrical surface of the driven shaft (2). It becomes possible to use a single or common sensor (6) to detect the relative phase and the shift amount of the cam shaft (2). The total part number is reduced, the assembling is simplified, and the manufacturing cost is reduced.

Furthermore, alternately arranging the angle detecting teeth (5*a*) and the shift detecting teeth (5*b*) makes it possible to quickly detect the phase differences.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A variable valve timing control apparatus for an internal combustion engine, comprising:

a driven shaft driven by a driving force of the internal combustion engine;

a cam provided on said driven shaft, said cam having a profile for opening or closing an associated valve of the internal combustion engine, said profile being variable from a high lift curve to a low lift curve in accordance with a movement of an engaging point between said cam and said associated valve in an axial direction of said driven shaft;

a driving mechanism for shifting said driven shaft in said axial direction;

a phase adjusting mechanism for adjusting the phase of said driven shaft relative to a driving shaft of the internal combustion engine;

at least one angle detecting tooth provided on a cylindrical surface of said driven shaft for detecting a rotational angle of said driven shaft;

at least one shift detecting tooth provided on said cylindrical surface of said driven shaft for detecting a shift amount of said driven shaft in said axial direction, said shift detecting tooth being inclined at a predetermined angle with respect to an axis of said driven shaft so as to provide angularly advanced and retarded portions in a rotational direction of said driven shaft;

a sensor for generating sensing signals responsive to said angle detecting tooth and said shift detecting tooth; and said sensor facing said angularly advanced portion of said shift detecting tooth when said low lift curve of said cam is selected in a low-speed operating condition of said internal combustion engine and facing said angularly retarded portion of said shift detecting tooth when said high lift curve of said cam is selected in an engine operating condition other than said low-speed operating condition.

2. A variable valve timing control apparatus in accordance with claim 1, wherein a plurality of angle detecting teeth are provided on said cylindrical surface of said driven shaft for detecting a rotational angle of said driven shaft;

a plurality of shift detecting teeth are provided on said cylindrical surface of said driven shaft for detecting a shift amount of said driven shaft in said axial direction, each of said shift detecting teeth being inclined at a predetermined angle with respect to said axis of said driven shaft so as to provide angularly advanced and retarded portions in said rotational direction of said driven shaft;

said sensor generates sensing signals responsive to said angle detecting teeth and said shift detecting teeth; and said angle detecting teeth and said shift detecting teeth are alternately arranged.

3. The variable valve timing control apparatus in accordance with claim 1, wherein said at least one angle detecting tooth is disposed in parallel to the axis of said driven shaft.

4. The variable valve timing control apparatus in accordance with claim 2, wherein there are two said angle detecting teeth disposed at angular intervals of 180° on said cylindrical surface.

5. The variable valve timing control apparatus in accordance with claim 2, wherein there are two said shift detecting teeth disposed at angular intervals of 180° on said cylindrical surface.

* * * * *